US008994530B2

(12) United States Patent
Amis

(10) Patent No.: US 8,994,530 B2
(45) Date of Patent: Mar. 31, 2015

(54) SYSTEMS AND METHODS TO ACTIVATE A SECURITY PROTOCOL USING AN OBJECT WITH EMBEDDED SAFETY TECHNOLOGY

(76) Inventor: David Amis, Durango, CO (US)

( * ) Notice: Subject to any disclaimer, the term of this patent is extended or adjusted under 35 U.S.C. 154(b) by 145 days.

(21) Appl. No.: 13/409,435

(22) Filed: Mar. 1, 2012

(65) Prior Publication Data

US 2013/0229281 A1 Sep. 5, 2013

(51) Int. Cl.

| | |
|---|---|
| ***G08B 13/00*** | (2006.01) |
| ***G08B 13/16*** | (2006.01) |
| ***G08B 13/196*** | (2006.01) |

(52) U.S. Cl.

CPC ..... *G08B 13/16* (2013.01); *G08B 13/196* (2013.01)

USPC ..... 340/541; 340/566; 340/568.8; 340/572.1

(58) Field of Classification Search

USPC ..... 340/541, 540, 566, 568, 568.8, 572.1

See application file for complete search history.

(56) References Cited

U.S. PATENT DOCUMENTS

| | | | | |
|---|---|---|---|---|
| 2002/0014974 | A1* | 2/2002 | Ghahramani | 340/815.4 |
| 2002/0189361 | A1* | 12/2002 | Hadden | 73/657 |
| 2006/0176369 | A1* | 8/2006 | Meritt | 348/143 |
| 2010/0245583 | A1* | 9/2010 | Harel | 348/159 |
| 2010/0302025 | A1* | 12/2010 | Script | 340/539.1 |

* cited by examiner

*Primary Examiner* — Steven Lim
*Assistant Examiner* — Hongmin Fan
(74) *Attorney, Agent, or Firm* — Maulin Shah; Joseph Stecewycz

(57) ABSTRACT

The present invention provides means for initiating a distress signal by knocking over an object, such as a table, decorative piece, furniture, etc., that includes a built-in or embedded safety device. When the safety device senses substantial movement (i.e., toppling) of the object, the safety device transmits a distress signal to third-party responders, and also can initiate various events in the environment surrounding the object to deter, delay, or disrupt a perpetrator.

19 Claims, 4 Drawing Sheets

SYSTEMS AND METHODS TO ACTIVATE A SECURITY PROTOCOL USING AN OBJECT WITH EMBEDDED SAFETY TECHNOLOGY

CROSS-REFERENCE TO RELATED APPLICATIONS

The present application claims the benefit of U.S. Non-Provisional patent application Ser. No. 13/348,566, filed on Jan. 11, 2012, which claims the benefit of U.S. Non-Provisional patent application Ser. No. 12/862,117, filed on Aug. 24, 2010, which claims the benefit of U.S. Provisional patent application No. 61/236,265, filed on Aug. 24, 2009. The present application further claims the benefit of U.S. Provisional patent application No. 61/497,109, filed on Jun. 15, 2011. The contents of each of the afore-mentioned patent applications are hereby incorporated by reference in their entireties.

BACKGROUND

1. Field of the Invention

The present invention relates generally to the field of safety management, and more specifically, to systems and methods to initiate various alarms and events by knocking over objects with built-in and/or embedded safety mechanisms.

2. Description of Related Art

We are constantly reminded of the need for personal and home safety in today's society. Over 7 million U.S. homeowners have home/building alarm systems which are meant to protect them from burglars, home invasion, and fire. These alarm systems trigger approximately 2.5 false alarms per year, and when a real alarm is triggered, rarely do alarm monitoring companies respond on time.

In addition, traditional building alarm systems do nothing for domestic violence, date rape, and other such assaults that occur when such alarms are turned off. According to the Colorado Coalition Against Sexual Assault, one in six American women have experienced or will experience an attempted or completed rape at some point during their life. In addition, there are over 1.5 million rapes per year in the United States alone, the majority occurring in the victims homes by someone known to the victim; someone who would never be detected by a traditional building alarm system.

Some traditional building alarm systems include "panic buttons", however, this is rarely used as an option due to lack of knowledge by the user. Furthermore, a vast majority of professional women ages 25-45 do not own homes or alarm systems. In addition, traditional building alarm systems are not child-friendly, and are not designed for easy use by children.

Therefore, there is a need for a system and method that provides a simple, inconspicuous, and easy-to-use means to call for help in the event of a break-in or threatening situation, and which addresses the above-mentioned drawbacks of traditional building alarm systems.

SUMMARY

In an embodiment, the present invention relates to a safety device, comprising: a sensor configured to detect a value comprising at least one of a shock value, a vibration value, an audible value, an acceleration value, a rotational value, or a temperature value; a processor coupled to the sensor, the processor configured determine if the value exceeds a predetermined threshold; a signal transceiver coupled to the sensor; a data capture means; an audio output means; and a video display screen; wherein the signal transceiver is configured to transmit a distress signal including at least one of a location data, an audio data, or a video data, to a remote location if the processor determines that the value exceeds the predetermined threshold.

In another embodiment, the present invention relates to a method of initiating a distress signal from a security device, comprising: receiving an input value from a sensor; comparing, at a processor, the input value to a pre-determined threshold value; transmitting a command to a signal transceiver from the processor if the input value is greater than or equal to the pre-determined threshold value; transmitting a distress signal including a location data, an audio data, and a video data if the input value is greater than or equal to the predetermined threshold value; and activating a data capture means if the input value is greater than or equal to the predetermined threshold value.

In yet another embodiment, the present invention relates to a device to initiate a security protocol, comprising: a housing having a base portion and a top portion, wherein the base portion has a larger surface area than the top portion; a sensor located within the housing, the sensor selected from a group consisting of a motion sensor, a vibration sensor, a temperature sensor, and an angular displacement sensor; a processor coupled to the sensor, the processor configured to receive an input value from the sensor, the processor further configured to compare the input value to a threshold value; and a signal transceiver coupled to the processor, the signal transceiver configured to transmit a distress signal to a remote location if the input value is greater than the threshold value.

BRIEF DESCRIPTION OF THE DRAWINGS

These and other embodiments of the disclosure will be discussed with reference to the following exemplary and non-limiting illustrations, in which like elements are numbered similarly, and where.

DETAILED DESCRIPTION

The various events discussed below are described in more detail in U.S. non-provisional patent application Ser. No. 13/348,566, filed on Jan. 11, 2012, entitled, "Systems and Methods Utilizing Sensory Overload to Deter, Delay, or Disrupt a Potential Threat", the contents of which is hereby incorporated by reference in its entirety. These events are described herein as Sensory Events, and they can be triggered by the present invention in a particular situation, in order to notify third-parties, distract the perpetrator, and assist a victim in the event of a threatening situation.

Figure 1:
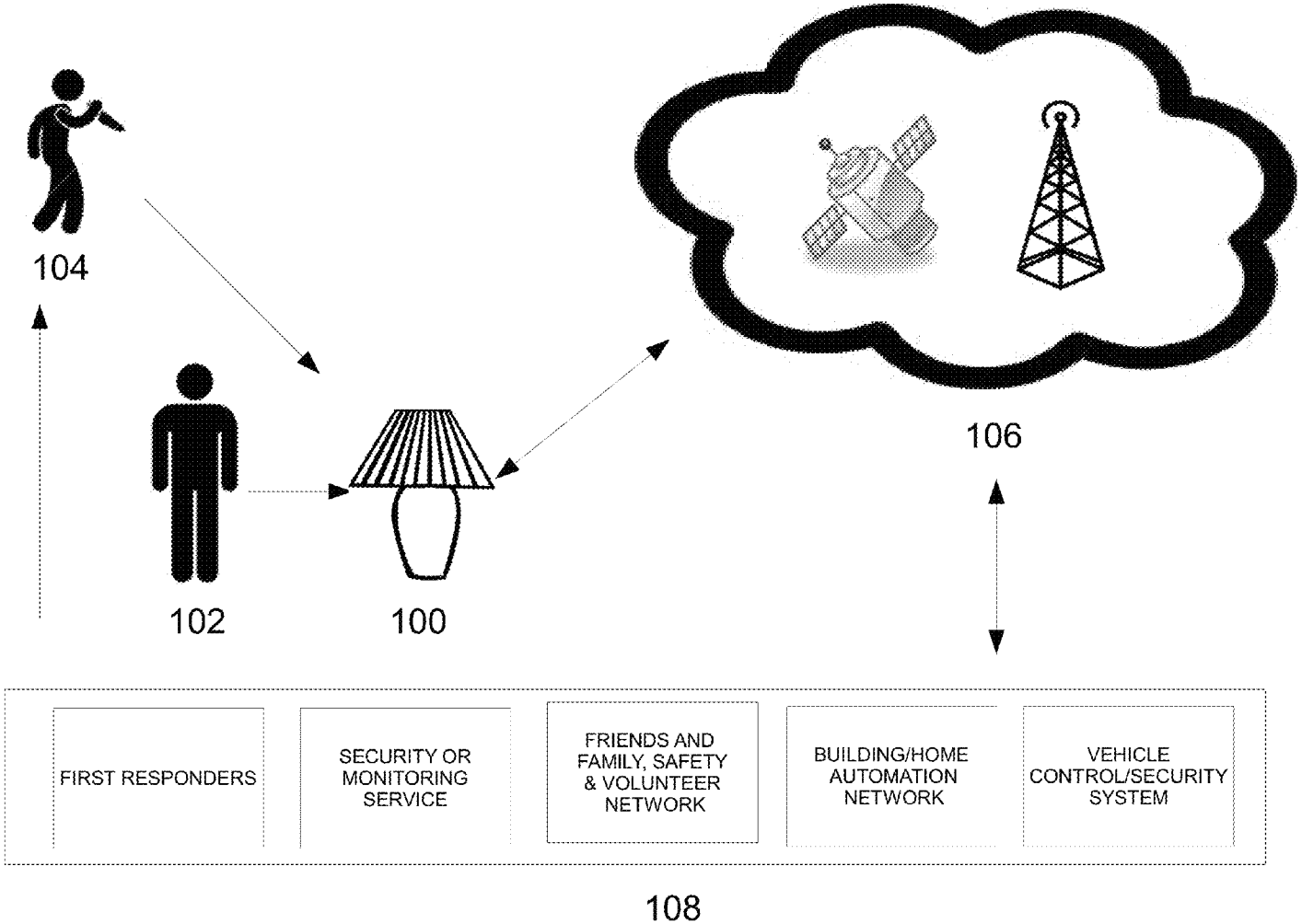
FIG. 1 is a block diagram of a security network in accordance with an embodiment of the present invention.

FIG. 1 is a block diagram of a security network in accordance with an embodiment of the present invention. Referring to FIG. 1, an object 100 can be any household or office object that is inconspicuous to most people, where the object 100 includes circuitry and means for triggering a distress signal to a third-party 108. For example, the object 100 can be a lamp, table, desk, furniture, television, stereo, speakers, plant holder, vase, table clock, wall-mounted clock, artwork, decorative pieces, computer, safe, stool, box, dresser, nightstand, couch, phone, statue, blender, coat rack, umbrella holder, or any such household or office object or item. In a preferred embodiment, the object 100 has a weight or size such that it will not move or be knocked over with slight contact or everyday use. Ideally, the object 100 requires a force more than a casual contact in order to move, shake, topple, or be knocked over.

In an embodiment, the object 100 can be used as a potential barrier between the user 102 and the perpetrator 104. Furthermore, since the object 100 triggers a distress signal by being knocked over, the user 102 can operate the object 100 in an intoxicated, drugged, tired, beaten, or injured state simply by applying force or body weight to the object 100. No complex manipulation of buttons, switches, or codes is required to trigger a distress signal.

In an embodiment, during a home or office invasion or break-in by a perpetrator 104, the user 102 can topple or knock over the object 100, thereby causing circuitry (described in more detail below and in FIG. 2) within the object 100 to transmit a distress signal to third-parties 108, such as such as, but not limited to, 911 emergency call centers, first responders systems, third-party monitoring services, friends and family networks, a volunteer network (including unknown parties), a safety network, a subscriber network, building/home automation networks, vehicle control/security systems, outdoor lighting control systems, municipal control grids for lighting and traffic, safety networks, telecommunication servers, neighboring security and/or communication networks, etc.

In another embodiment, the object 100 initiates a security protocol using built-in components (as opposed to sending a distress signal to a remote location so that a protocol can be initiated). For example, the object 100 can initiate video and audio monitoring, vibration, emit various sounds and lights, etc. upon activation.

The distress signal can be transmitted via a communication network 106, which can include wireless networks, short-range protocol networks, hard-wire and cable networks, or any combination thereof.

The distress signal transmitted from the object 100 can include location information of the object 100, timing data, and other information such as, but not limited to, temperature and weather conditions in the object's surrounding environment, and velocity and/or intensity of movement and force applied to the object.

Upon receiving a distress signal from the object 100, a third party 108 such as a 911 emergency call center can notify first responders such as the police department, fire department, emergency medical services to proceed to the location of the object 100 (i.e., the location of the user 102).

In another embodiment, the distress signal transmitted from the object 100 can be received by a remote monitoring center. Upon receipt of the signal, the remote monitoring center can notify a 911 emergency call center or first responders, as well as notify neighbors, friends and family members, and members/volunteers of a safety network (i.e., Spartans, as described in U.S. Non-Provisional patent application Ser. No. 12/862,117, filed on Aug. 24, 2010) who are in the vicinity of the user's home. The Spartans may be able to reach the user's home and provide assistance/crowding before first responders arrive.

In yet another embodiment, the object 100 can be coupled to a security network that includes objects in neighboring homes as well as the user's home. The object 100 can instruct that lights, appliances, etc. be activated in neighboring homes. For example, upon a break-in, the object 100 can immediately activate lights in the user's home, as well as outside and insides lighting in neighboring homes, in a predetermined or random pattern. For instance when the object 100 senses that the perpetrator 104 has exited the home, the object 100 can command objects in neighboring homes to activate outside flood lights in order, so that as the perpetrator 104 runs or drives away, lighting will be activated along the perpetrator's escape path.

The distress signal can also be triggered by a perpetrator 104, by a perpetrator 104 themselves knocking over the object 100. For example, a perpetrator 104 who is quickly going through a room in a house looking for valuables may haphazardly knock over items on a desk or table. If the object 100 is knocked over in such a fashion, third-parties 108 can be notified that a possible burglary is in progress, even if the user 102 is not at home.

In yet another embodiment, an animal, such as a dog or cat, can be trained to knock over or contact the object 100 in order to activate the distress signal.

Figure 2:
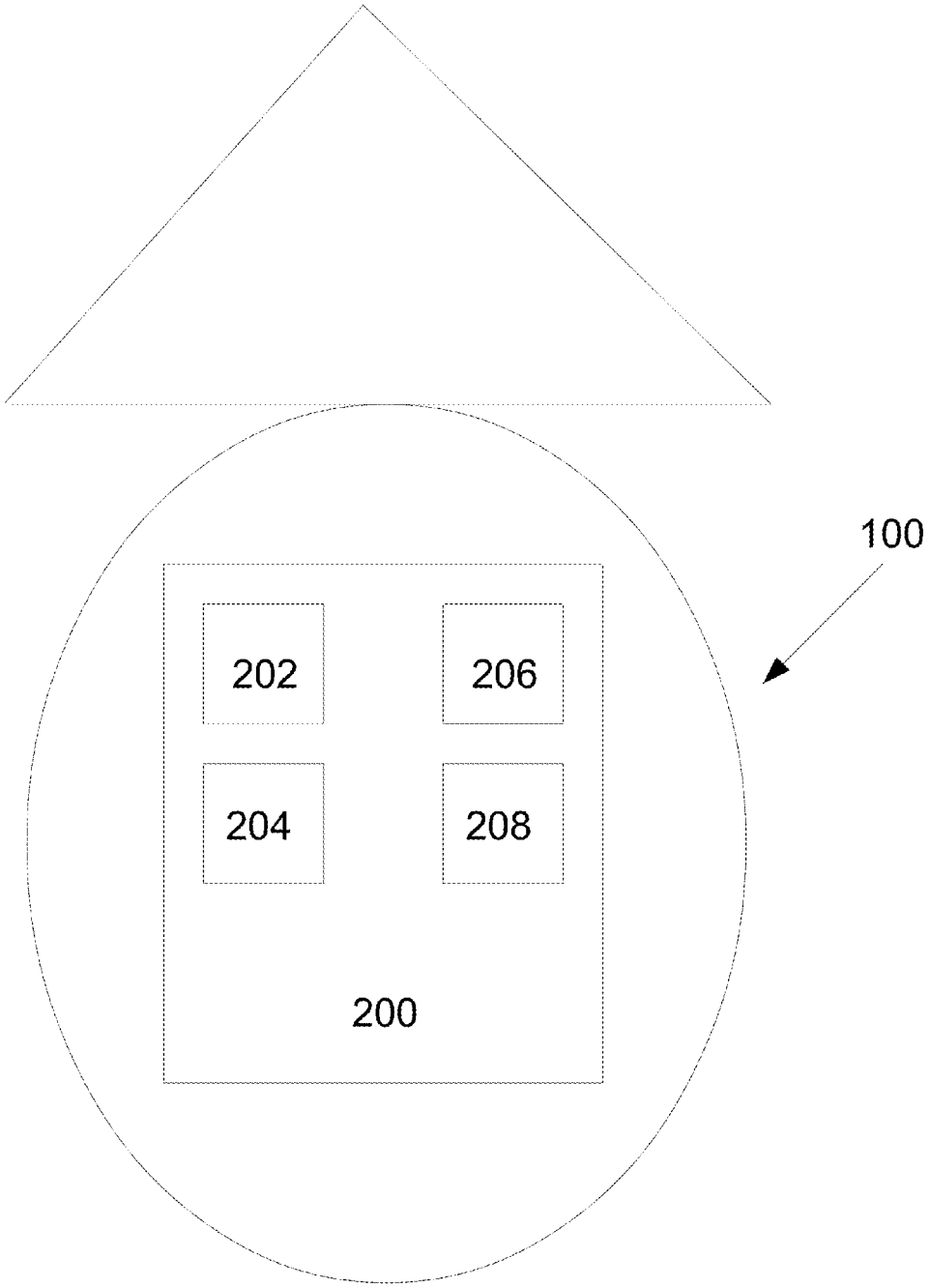
FIG. 2 is a block diagram of the internal components of an object with security signaling capabilities according to an embodiment of the present invention.

FIG. 2 is a block diagram of the internal components of an object with security signaling capabilities according to an embodiment of the present invention. The object 100 includes a controller 200. The controller 200 is communicatively coupled to a motion detector 202, a signal transceiver 204, audiovisual output means 206, and data capture means 208. The controller 200 can be a processor, either within the object 100 (or any other computing device), or at a remote location, such as a remote monitoring center, or in a third-party computing device.

The controller 200 can be a human being, such as an operator at a remote monitoring center, a 911 operator, or any third-party human being such as members of a friends and family network, security network, and neighbors. In this embodiment, the controller 200 is coupled to the object 100 via a communication link.

In an embodiment, the motion detector 202 is comprised of an accelerometer, velocity sensor, gravimeter, gyroscope, oscillator, tiltmeter, inclinometer, displacement sensor, or any combination thereof to detect sudden movements, free-fall, crashing into a surface, etc. Any such movements can trigger a distress signal being transmitted. In another embodiment, the motion detector 202 can be a vibration detector, such as a piezoelectric sensor or pressure transducer, which can detect the level of shock, impact or force on the object 100.

In an embodiment, a motion detector 202 is coupled to the controller 200, and can be programmed so that a distress signal is activated only when a certain motion threshold is met. For example, the motion detector 202 can be set to trigger the distress signal only when the motion detector 202 senses an inclination of at least 90 degrees, senses an acceleration of at least 5 feet per second, or a rotation of at least 2 revolutions per second. In a preferred embodiment, the motion detector 202 can trigger a distress signal when it senses an inclination of between 40 degrees and 360 degrees, senses an acceleration of 1 foot per second to 320 feet per second, or a rotation of 1 revolution per second to 100 revolutions per second.

Thus, if the object is casually touched or bumped, the threshold movement will not be sensed by the motion detector 202, causing a distress signal to be triggered. A significant movement or motion of the object 100 is required for the distress signal to be triggered. For example, if the motion detector 202 is a vibration detector, a distress signal is triggered only when the amount of vibration, shock, impact, or force on the object 100 is above a predetermined threshold amount.

In an embodiment, the controller 200 is also coupled to a signal transceiver 204. The signal transceiver 204 can be a modem, Ethernet, or landline telephone connection, as well as a wireless signal transmitting and receiving unit, such as a cellular phone or pager. The signal transceiver 204, in a preferred embodiment, is configured to wirelessly transmit a distress signal via the communication network 106 to third-parties 108 or to a remote controller (i.e., when the controller is located at a remote monitoring center, for example), and the signal transceiver 204 can use utilize wireless networks, short-range protocol networks, hard-wire or cable networks, and any combinations thereof.

In an embodiment, third parties 108, such as a remote monitoring center can transmit a signal back to the object 100 by sending a signal to the signal transceiver 204 via the network 106. Such a signal can include commands to output audio sounds through a speaker in the object 100, or commands to initiate recording via a microphone or camera in the object 100, as described in more detail below.

In addition to transmitting a distress signal to alert third-parties 108, the controller 200 can decide to activate various Sensory Events to re-orient the focus of the perpetrator from committing a crime to trying to figure out what is going on in the environment around them.

In yet another embodiment, the signal transceiver 204 can be communicatively coupled to building/home automation networks, vehicle control/security systems, outdoor lighting control systems, etc. In this embodiment, the signal transceiver 204 can use a short-range wireless protocol, such as Bluetooth, Zigbee, or a ghost protocol, to connect with nearby devices including appliances, lights, home entertainment systems, and mobile communication devices that are in the vicinity of the device. For example, the signal transceiver 204 can pair with nearby devices and transmit a "power on" command, so that a television is automatically turned, the microwave starts beeping, music is played from a radio, a cellular phone begins to ring, etc.

In another embodiment, the controller 200 can track portable devices of persons living in the home. For example, a family can register their cellular phones with the object 100. The controller 200 stores registered phone data either in an internal memory, or externally on a remote server. The controller 200 can sense, via a short-range wireless protocol, or via GPS satellite tracking, the location of each registered cellular phone. For example, if the controller 200 determines that only the cellular phones of children are present in the home, and that the cellular phones of the parents are miles away, the controller 200 can put the object 100 on a heightened alert, and initiate appropriate security protocols (such as notifying a third-party monitoring center, or neighbors).

In this embodiment, members of the household can also proactively "check-in" and "check-out" with the object 100 whenever they enter or leave the home. A user can "check-in" with the object 100 as they are driving home from work, so that the object 100 can be placed in an alert status, and warn the user 102 of any suspicious activity occurring in or near the home. The user 102 can be warned remotely before they reach home, and can then take appropriate cautions or request assistance from third-parties.

For example, the controller 200 can be coupled to the user's home automation network. Upon triggering of a distress signal, various events can occur throughout the user's home, such as a pre-recorded message can be played on the home speaker system with a man's voice stating "Honey, I'm home!", a dog barking, children's voices, etc. In addition, simultaneous to the pre-recorded message, lights in different rooms in the house can turn on. The lights in all of the rooms can turn on all at once, or they can be turned on in a pre-determined or random order. The lights can also turn on, and then off, repeatedly, in a pre-determined or random order.

The controller 200 can instruct a third-party to repeatedly call the landline in the home, and provide a pre-recorded or live message in the event a perpetrator decides to pick up.

Along with lights, various household appliances, such as televisions, radios, alarm clocks, microwaves, dishwashers, coffee makers, and computers can be powered-on or activated.

Additionally, the garage door can open/close at the same time, as well as other doors in the house that are motorized and connected to the security system (i.e., pantry, porch, front, closet, bathroom, etc. doors).

Furthermore, the controller 204 can also activate all recording devices in the home or nearby area, such as computers/laptops with a video camera, security cameras, and devices with audio recording capabilities (i.e., smart phones, PDAs, etc.), and any other multifunction communication or multimedia device that currently exists or may be available in the future. The controller 200 can link the signal transceiver 204 to various devices in the home via a wireless pairing connection, such as, for example, Bluetooth or Zigbee.

In another embodiment, the object 100 includes only a signal transmitter, enabling one-way communication between the object 100 and third-parties 108 via the communication network 106. In this embodiment, the object 100 can transmit a distress signal to third-parties 108, but cannot receive or process incoming signals or commands from third-parties.

The controller 200 can also include an output means 206, such as a speaker, light, gas dispenser, or odor emitter. For example, if a distress signal is triggered, then the object 100 can automatically dispense gas, pepper spray, mace, or any other mist or spray type emission to the surrounding area in order to deter or distract the perpetrator 104. In another embodiment, the object 100 can emit a foul odor to its surrounding area.

In another embodiment, the object 100 can include a speaker that is configured to sound an audible alarm, high frequency pitches, or pre-recorded message, such as, "911 has been contacted, authorities are en route." The audible alarm can also emit the sound of a dog barking, a window breaking, a vehicle approaching, a police officer's voice, or another voice or voices.

In yet another embodiment, the object 100 can include a light that can flicker, blink, or flash when a distress signal has been triggered. The controller 200 can activate a blinking light on the object 100 or any other light that is communicatively coupled to the controller 200, flicker a camera flash, emit sounds of cameras taking pictures, emit music, can vibrate or provide tactile sensations, can emit a high level of heat so that it is hot to the touch, or emit other pre-recorded messages at pre-determined intervals (i.e., 2 seconds, 5 seconds, etc.). Having multiple events occurring (music, lights, flash, recorded messages, etc.) can serve to deter, delay and distract the perpetrator 104 or disrupt or decrease the intensity of the criminal act. In addition, the present invention can calm down the perpetrator 104, or deplete their anger level if a perpetrator is acting in the heat of passion.

The object 100 can also include data capture means 208, such as a microphone and/or cameras. In this embodiment, the data capture means 208 are automatically activated when a distress signal is triggered. The object 100 can then transmit audio, photographs, and/or video from the scene directly to a third-party 108. The third-party 108, such as a remote monitoring center, may control the data capture means 208, and selectively record or move the data capture means 208. For example, the audio, photographs, and/or video can be streamed live directly to a user's social networking account, such as to a Facebook wall or MySpace page.

In an embodiment, images or video of the perpetrator 104 can be transmitted to a remote monitoring center where facial recognition can be performed to determine the perpetrator's identity. Alternatively, the user 102 can say the perpetrator's name, and the remote monitoring center can compare the name with the user's stored contacts on their mobile device (which can be synced and accessed by the remote monitoring center). In yet another embodiment, the perpetrator's voice can be captured for voice-analysis and recognition purposes.

For example, the object 200 can capture an image of the perpetrator 104 and perform facial recognition to determine the perpetrator's identity. Alternatively, the user 102 can select a name from their contact list stored in the portable device 102, or the user 102 can select a name or person from a social networking profile from a computing device (i.e., computer, tablet, phone, etc.), that is communicatively coupled to the object 100 to identify the perpetrator 104.

Once the perpetrator's identity is confirmed, the remote monitoring center can access a perpetrator's profile from various third-party databases, including law enforcement databases, federal government databases, INTERPOL, and court record databases.

In yet another embodiment, the object 100 can include a display screen that shows video that is being captured either by the object 100 or remote video capture devices (i.e., cellular phone cameras or security cameras in the room or building that have been activated by the object 100). The perpetrator 104, upon seeing themselves being recorded, may disengage and leave the scene.

In another example, the display screen can show live video of third-party responders, such as police officers, responding to the scene to assist the user 102. The video can be, for example, a live feed from a dash-mounted video camera in the police cruiser.

In an embodiment, the controller 200 can itself perform the facial, audio, and/or voice recognition, as well as directly access information regarding the perpetrator's educational background, military service record, and employment history through public and private database sources. The controller 200 can then initiate various Sensory Events based on the perpetrator's profile as described in U.S. non-provisional patent application Ser. No. 13/348,566.

In an embodiment, the object 100 can also include a memory for storing any captured data, such as audio or video data, as well as timing, temperature, and weather data. The memory can be encased within a "black box" structure that is difficult for a perpetrator to identify or locate, and which is in a fortified housing so that it cannot be destroyed due to extreme temperatures (i.e., fire, cold weather, rain, etc.), or damaged when the object 100 is knocked over or toppled. Similarly, the memory can be remotely located, such as at a remote monitoring center, and where all data received from the signal transceiver 204 is securely stored and can later be used for law enforcement or investigative purposes. In addition, a GPS transponder can be located within the black box so that the object 100 can be tracked and possibly recovered if it is removed from the user's location.

In another embodiment, the object 100 can include a glass break detector. The glass break detector can be triggered by the sound, pitch, and/or vibration of glass breaking or shattering. In this embodiment, the controller 200 is placed within a glass object, such as a flower pot, vase, picture frame, or glass-top table. The user 102 can simply smash the glass surface to trigger a distress signal.

In another embodiment, the distress signal can be triggered using voice commands by the user 102 or by the perpetrator 104. A microphone and audible sensor can be used to capture and process the voice command. The microphone can be located within the object 100 as described above, or alternatively, it can be built-into the surrounding environment (within walls, ceiling, hidden within objects in a room, automobile compartments, etc.). In this embodiment, pre-determined words can be stored in the memory, such as "help", "rape", "intruder", "shut up", etc. During a threatening event, if the user 102 utters a pre-programmed word in the vicinity of the object 100, the object 100 can trigger a distress signal to third-parties 108. A volume, pitch, or loudness sensor can be used to determine the user's voice level, so that the distress signal is only triggered if the user's voice level is above a certain decibel threshold. This ensures that everyday speaking and casual utterances of any of the pre-programmed words would not trigger a distress signal.

In another embodiment, the object 100 can include a motion sensor or proximity sensor, such as a capacitive sensor, laser rangefinder, magnetic sensor, eddy-current sensor, photocell sensor, infrared sensor, thermal sensor, sonar sensor, ultrasonic sensor, and/or microwave sensors. The motion sensor can determine if a person, such as the user 102 or perpetrator 104 is near the object 100. In this embodiment, if the motion sensor detects movement near the object 100, a warning signal can be transmitted to third-parties 108 putting them on alert. For example, upon receiving a warning signal, a remote monitoring center can activate cameras and or microphones on the object 100 and monitor the scene in real-time. The object 100 can be placed in an obscure location such that only the user 102 would know to go near it to activate a warning signal. In another embodiment, the object 100 can be placed near an entryway so that a perpetrator 104 who enters the building and passes the object 100 would trigger the warning signal.

In yet another embodiment, the object 100 can be integrated within a wall, so that a perpetrator 104 cannot discern the object 100 or its location. However, the user 102 would know exactly where the object 100 is embedded into the wall. For example, during a break-in or attack, the user 102 can throw items to a specific location on the wall where the object 100 is embedded, causing vibrations that activate the distress signal. In another embodiment, if the user 100 is under imminent attack, the user 102 can strategically position themselves near the wall where the object 100 is embedded, thereby banging or hitting the wall if they are actually attacked, and causing the distress signal to be triggered.

In yet another embodiment, the object 100 includes a magnet. The user 100 can simply place another metal object near the object 100 to activate the magnet, which then activates the distress signal. For example, the user 100 could throw a watch (with a metallic casing or strap) or coins at the object 100 or the area of the wall where the object 100 is embedded.

In an embodiment, the controller 200 can be powered via an external power source, such as a traditional wall-plug outlet. The object 100 can include an internal battery-backup, in the event that the external power source is turned off or inaccessible. The internal battery can be any type of primary cell (non-rechargeable) or secondary cell (rechargeable) battery, such as, but not limited to, alkaline, aluminum, dry cell, galvanic, lithium, mercury, silver-oxide, voltaic pile, zinc-air, zinc-carbon, zinc chloride, flow, fuel cell, lead-acid, nickel-zinc, nickel-iron, potassium-ion, silicon air or zinc-matrix.

In another embodiment, the object 100 can include solar cells, so that when the object 100 is placed near a window, skylight, etc., the internal battery is charged and/or energized.

In addition, the object 100 can utilize a back-up power source as well, in the event of an external power failure or drain on the main power supply. In an embodiment, when the power supply is extremely low, or when the power supply is detached from or removed from the object 100, broken open, slammed, sensing extreme heat (i.e., a fire) or electronically jammed, a final distress signal is transmitted, indicating that the object 100 may no longer communicate with the network 106.

Figure 3:
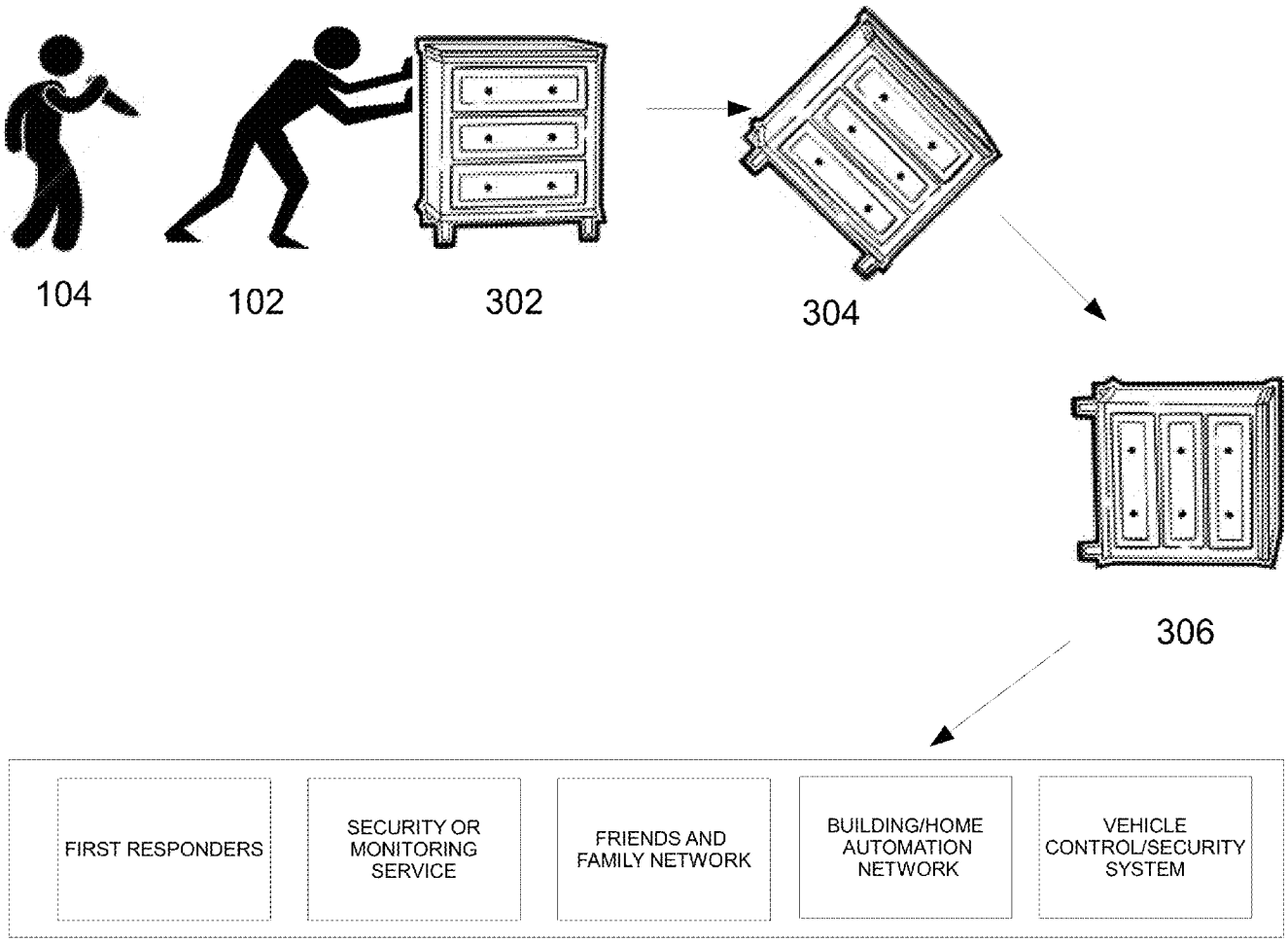
FIG. 3 is a block diagram illustrating triggering of a distress signal according to an embodiment of the present invention.

FIG. 3 is a block diagram illustrating triggering of a distress signal according to an embodiment of the present invention. In an embodiment, the object 100 is a dresser 302. The user 102, upon being threatened by a perpetrator 104, can push the dresser 302 so that it is tilted, as illustrated by the tilted dresser 304. The user 102 can continue to push the dresser 302 until it is fallen to the floor, as illustrated by the toppled dresses 306. The controller 200 can sense the angle of inclination of the dresser 304, and if the inclination is at least a pre-determined angle, as described above, a distress signal is transmitted the signal transceiver via the network 106 to third-party responders 108.

In yet another embodiment, the object can be a small, hand-held item, such as a paperweight, snow globe, picture frame, cordless phone, or any other item that could easily be picked up and thrown at a perpetrator 104 or on the floor or against a wall. In this embodiment, the hand-held object contains the above-described circuitry and communication means. The user 102 can simply throw the object against a hard surface, causing it to break or impact at a high velocity. Upon impact or breaking, a distress signal is triggered. In this embodiment, all of the circuitry required to transmit a distress signal and control Sensory Events are protected in a black box as described above so that they are protected upon impact of the object. In this embodiment, the object can be used as a self-defense weapon and the user 102 can throw the object directly at the perpetrator 104.

In another embodiment, the user 102 can trigger the distress signal via a remote control, such as with their mobile device, PDA, watch, keychain, etc., as described in U.S. Non-Provisional patent application Ser. No. 13/159,596, filed on Jun. 14, 2011, entitled "Systems and Methods for Initiating a Distress signal from a Mobile Device Without Requiring Focused Visual Attention from a User", the contents of which is hereby incorporated by reference in its entirety. For example, the user 102 can trigger the distress signal via a panic button on a necklace that they wear to bed, in the shower, etc.

Figure 4:
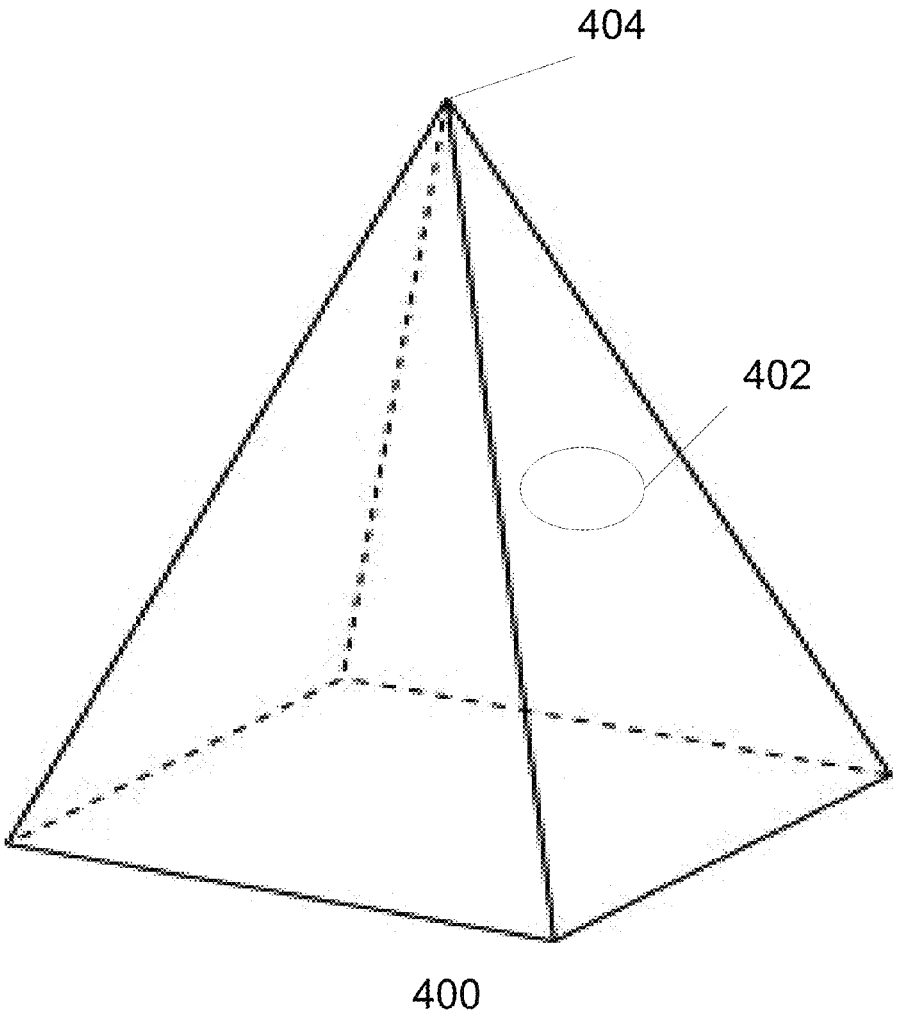
FIG. 4 is an exemplary embodiment of a pyramid-shaped object.

FIG. 4 is an exemplary embodiment of a pyramid-shaped object. In this embodiment, the pyramid object 400 has a large base, making it difficult for the pyramid object 400 to be easily toppled or inadvertently knocked over. Also, since its unique three-pointed shape, casual visitors to the user's home or office will not be inclined to pick up the pyramid-object. In an embodiment, the pyramid object 400 includes data capture means 402, which, as described above, can include audio and video recording devices. The pyramid object 400 can also include a display screen as described above.

In addition, the pyramid object 400 can be used as a weapon, and thrown against a perpetrator 104 to initiate a distress signal, and to thwart the perpetrator.

The object 400 can include button 404 at its peak (or at another location on the pyramid), allowing the user 102 to quickly activate a signal or monitoring sequence. In another embodiment, the object 400 can include multiple activation buttons, each for a pre-defined or user-customizable situation. For example, there could be separate buttons for "On a Date", "Service Person in the House", "Waiting for Food Delivery", "Lawn Care People Outside", etc. Each of these situations has slightly different protocols if a distress signal is activated, and they all require the user 102 to check-in during pre-determined intervals (every 5, 10, 20, and/or 30) minutes with the object 400. The check-in can occur by physical touching of the object, biometric identification (fingerprint or iris scan), voice password, or check-in via a mobile device.

In another embodiment, the object 400 can have weighted edges, a weighted lower portion relative to its top, an extremely smooth underside, round edges that cause tipping, or any other design feature that would assist the object 400 in turning over when it reaches the end of a support structure, such as a table or desk.

In yet another embodiment, the surface of the object 400 can include fingerprint capturing technology, such as multi-spectral imaging that captures surface and subsurface impressions. The surface can also record surface temperature, compression and gripping pressure, be resistant to extreme heat or cold (i.e., resistant to fire and frost), and includes means to avert electronic signal jamming.

In yet another embodiment, the object 400 includes a electronic jamming means, such as a radio frequency jammer, infrared jammer, or a signal obfuscator, whereby upon activation, a perpetrators mobile communication device would be disabled from outgoing or incoming communications.

In addition, the object 400 can include an indicator to display a current threat level, such as green, yellow, or red. By glancing at the indicator, the user 102 can easily determine if the object 400 is reacting to the surroundings. For example, during a break-in, if the user cannot manually activate the distress signal, the controller 200, as described above, may still sense an intrusion and proceed with contacting third-parties and monitoring the environment. Upon automatically sensing a threat, the object 400 may have a yellow or red blinking light indicator to inform the user 102 that help is on the way.

In yet another embodiment, the object 400 can be in a travel-sized form, so that a user 102 can take it with them on vacations, business trips, hotels stays, etc. The travel-sized pyramid object has a similar controller as described above, and can perform substantially the same functions as a normal sized object 400.

In other embodiments, the object 400 can have a half-globe shape, a pentagon shape, or any other polygon or curved shape that would not invite someone to pick up or manipulate the object 400, or make it difficult for someone to casually hold the object 400.

The above embodiments can be incorporated not only in a home or office environment, but also in hotel rooms, dorm rooms, vehicles, airplanes, and jail cells. For example, the object 100 can be embedded within standard issue room lamps, chairs, desks, trash cans, televisions, etc.

The above embodiments are not limiting, and the systems, responses, and methods described above can be applied to building alarm systems, business alarm systems, perimeter defense systems, airplane/cockpit defense systems, and any situation where personal and/or property safety may be endangered by a perpetrator.

While the principles of the disclosure have been illustrated in relation to the exemplary embodiments shown herein, the principles of the disclosure are not limited thereto and include any modification, variation or permutation thereof.

What is claimed is:

1. A safety device, comprising:

a pyramid-shaped housing;

a sensor configured to detect an input value comprising at least one of a shock value, a vibration value, an audible value, an acceleration value, a rotational value, or a temperature value, the sensor enclosed within the pyramid-shaped housing;

a processor coupled to the sensor, the processor configured determine if the input value exceeds a predetermined threshold;

a signal transceiver coupled to the processor;

a data capture means coupled to the processor;

an audio output means coupled to the processor; and a video display screen coupled to the processor, wherein the signal transceiver is configured to transmit a distress signal including at least one of a location data, an audio data, or a video data to a remote location if the processor determines that the value exceeds the predetermined threshold.

2. The safety device of claim 1, wherein the sensor is a motion sensor.

3. The safety device of claim 1, wherein the sensor is an audible sensor.

4. The safety device of claim 1, wherein the data capture means is selected from a group consisting of a microphone, a camera, and a video recorder.

5. The safety device of claim 1, wherein the signal transceiver is configured to transmit the distress signal via a wireless communication channel or a hard-wire communication channel.

6. The safety device of claim 1, wherein the sensor is selected from a gyroscope, tiltmeter, inclinometer, oscillator, and displacement sensor.

7. A method of initiating a distress signal from a security device, comprising:

receiving an input value from a sensor, the sensor enclosed within a pyramid-shaped housing;

comparing, at a processor enclosed within the pyramid-shaped housing, the input value to a pre-determined threshold value;

transmitting a command to a signal transceiver from the processor if the input value is greater than or equal to the pre-determined threshold value;

activating a data capture means enclosed within the pyramid-shaped housing if the input value is greater than or equal to the predetermined threshold value; and transmitting a distress signal including a location data, an audio data, and a video data if the input value is greater than or equal to the pre-determined threshold value to a remote location.

8. The method of claim 7, wherein the sensor is selected from a group consisting of a gyroscope, tiltmeter, inclinometer, oscillator, and displacement sensor.

9. The method of claim 8, wherein the processor transmits the command to the signal transceiver if the input value is an angular value greater than 90 degrees.

10. The method of claim 8, wherein the processor transmits the command to the signal transceiver if the input value is an angular value between 40 degrees and 360 degrees.

11. The method of claim 8, wherein data capture means is selected from a group consisting of a microphone, a camera, a video recorder, and a temperature sensor.

12. The method of claim 11, where the processor transmits the command to the signal transceiver if the input value is a motion value between 1 foot per second and 320 feet per second.

13. The method of claim 8, wherein the sensor is configured to detect a vibration, shock, impact, temperature, or force.

14. A device to initiate a security protocol, comprising:

a pyramid-shaped housing having a base portion and a top portion;

a sensor located within the pyramid-shaped housing, the sensor selected from a group consisting of a motion sensor, a vibration sensor, a temperature sensor, and an angular displacement sensor;

a processor coupled to the sensor, the processor configured to receive an input value from the sensor, the processor further configured to compare the input value to a threshold value; and a signal transceiver coupled to the processor, the signal transceiver configured to transmit a distress signal to a remote location if the input value is greater than the threshold value.

15. The device of claim 14, wherein the threshold value is a pre-determined value.

16. The device of claim 14, wherein the threshold value is a user-configurable value.

17. The device of claim 14, wherein the signal transceiver is configured to transmit the distress signal via a wireless communication channel or a hard-wire communication channel.

18. The device of claim 14, further comprising audiovisual emitting means.

19. The device of claim 14, further comprising data capture means enclosed within the pyramid-shaped housing.

* * * * *